US012156557B2

(12) United States Patent
Frank et al.

(10) Patent No.: US 12,156,557 B2
(45) Date of Patent: Dec. 3, 2024

(54) BARRIER LAYER FOR GARMENT

(71) Applicant: KJUS North America, Inc., Fairhaven, MA (US)

(72) Inventors: Amanda Frank, Erie, CO (US); Mary Stewart Waggoner, Longmont, CO (US); Tucker Sutter, Broomfield, CO (US); Adam Mueller, Denver, CO (US); Shogo Fujiwara, Westminster, CO (US); Colin Beard, Denver, CO (US)

(73) Assignee: KJUS North America, Inc., Boulder, CO (US)

( * ) Notice: Subject to any disclaimer, the term of this patent is extended or adjusted under 35 U.S.C. 154(b) by 0 days.

(21) Appl. No.: 18/077,978

(22) Filed: Dec. 8, 2022

(65) Prior Publication Data

US 2024/0188663 A1 Jun. 13, 2024

(51) Int. Cl.

| | |
|---|---|
| ***A41D 31/10*** | (2019.01) |
| ***A41D 1/02*** | (2006.01) |
| ***A41D 1/04*** | (2006.01) |
| ***A41D 1/082*** | (2018.01) |
| ***A41D 15/00*** | (2006.01) |
| ***A41D 27/04*** | (2006.01) |
| *A41D 3/00* | (2006.01) |

(52) U.S. Cl.

CPC ..... *A41D 31/10* (2019.02); *A41D 1/02* (2013.01); *A41D 1/04* (2013.01); *A41D 1/082* (2013.01); *A41D 27/04* (2013.01); *A41D 3/00* (2013.01); *A41D 15/002* (2013.01); *A41D 2400/10* (2013.01); *A41D 2400/422* (2013.01)

(58) Field of Classification Search

CPC . A41D 31/10; A41D 1/02; A41D 1/04; A41D 2400/10; A41D 2400/422; A41D 31/06; A41D 1/082; A41D 3/00

See application file for complete search history.

(56) References Cited

U.S. PATENT DOCUMENTS

| | | | | |
|---|---|---|---|---|
| 4,707,862 | A * | 11/1987 | Gerber | A41D 15/002 2/93 |
| 5,794,268 | A | 8/1998 | Pessey | |
| 5,946,724 | A | 9/1999 | Erickson | |
| 6,029,270 | A * | 2/2000 | Ost | A41D 27/04 2/2.5 |
| 6,079,051 | A * | 6/2000 | Whinston | A41D 13/0005 2/93 |
| 6,108,815 | A * | 8/2000 | Majerfeld | A41D 13/02 2/71 |
| 6,618,863 | B2 * | 9/2003 | Blechman | A41F 9/025 2/311 |
| 6,665,878 | B1 | 12/2003 | Way | |

(Continued)

FOREIGN PATENT DOCUMENTS

| | | |
|---|---|---|
| JP | 3158932 | 4/2010 |
| KR | 10-2011-0131348 | 12/2011 |

(Continued)

*Primary Examiner* — Clinton T Ostrup
*Assistant Examiner* — Akwokwo Olabisi Redhead

(57) ABSTRACT

A garment comprising a barrier layer. The barrier layer comprises a skirt and a storage region for retaining the skirt. The storage region comprises an upper flap, a lower flap, and a fastener for releasably coupling the upper flap and the lower flap to retain the skirt in the storage region.

20 Claims, 5 Drawing Sheets

FIGURE 1C

(56) References Cited

U.S. PATENT DOCUMENTS

| | | | | |
|---|---|---|---|---|
| 7,047,568 | B2 | 5/2006 | Hofmann | |
| 7,874,019 | B2 | 1/2011 | Woolcott et al. | |
| 10,617,157 | B2 | 4/2020 | West et al. | |
| 11,051,568 | B2 | 7/2021 | Reimer | |
| 11,083,278 | B2 | 8/2021 | Villaruz | |
| 2005/0022285 | A1 | 2/2005 | Berns et al. | |
| 2005/0044605 | A1 | 3/2005 | Hofmann | |
| 2010/0199404 | A1 | 8/2010 | Garza | |
| 2011/0041234 | A1 | 2/2011 | Blackford | |
| 2016/0029714 | A1 | 2/2016 | Linden et al. | |
| 2018/0132537 | A1 | 5/2018 | Siegfried | |
| 2019/0246723 | A1* | 8/2019 | Reimer | A41D 3/00 |
| 2022/0192284 | A1 | 6/2022 | Chen | |

FOREIGN PATENT DOCUMENTS

| | | |
|---|---|---|
| KR | 10-2012-0055781 | 6/2012 |
| RU | 178393 | 1/2006 |
| RU | 2690967 | 2/2019 |
| WO | 2005009155 | 2/2005 |

* cited by examiner

BARRIER LAYER FOR GARMENT

BACKGROUND

Various environments may have different environmental conditions that can affect or influence the comfort, mental state, and/or physical abilities of a subject. In some cases, a subject may perform one or more activities (physical and/or non-physical) in a relatively cool or cold environment, such as a cool or cold indoor environment (e.g., a temperature controlled indoor environment) or outdoor environment (e.g., an outdoor space in cold climates or during cold days, nights, mornings, afternoons, evenings, seasons, etc.). In cool or cold environments, a subject may want and/or need to wear garments suitable for the temperatures and/or climates of such environments. In some cases, the garments may need to shield or insulate the subject from cool or cold temperatures and/or climates while the subject engages in one or more activities.

SUMMARY

Garments designed for cool or cold environments may integrate or utilize a skirt that can be deployed or secured to another article of apparel to form a barrier layer. In some cases, the barrier layer may prevent snow or other precipitation from entering into an interior region of the garment and/or another article of apparel worn by a subject.

Recognized herein are various limitations of conventional skirt systems provided with garments designed for cool or cold environments. In some instances, conventional skirts may not be optimally designed for internal storage within a garment when the skirts are not in use. In many cases, garments can only partially accommodate the storage of a skirt, and may leave several portions or sections of the skirt exposed, which can negatively impact the fit and comfort of the garment when a subject wears the garment after stowing away the skirt. The present disclosure addresses at least the above shortcomings of conventional skirt systems by providing a garment with a skirt that can be fully hidden or concealed within a storage region of the garment and later deployed from the storage region when desired, without requiring a high level of dexterity or a complex series of steps to prepare or rearrange the skirt for storage/deployment. The garments of the present disclosure may ultimately provide a simpler and more elegant solution for storing and deploying skirts while preserving the fit, function, comfort, and aesthetics of the skirts and the overall garments.

The present disclosure generally relates to various examples and embodiments of garments with a barrier layer for insulating or shielding a subject's body from external objects or environments. In some non-limiting embodiments, the barrier layer may comprise a skirt (e.g., a snow skirt or a powder skirt) that is deployable by the subject. The skirt may be deployed around a subject's body to create a physical and/or thermal barrier around the subject's body.

In one aspect, the present disclosure provides a garment comprising a skirt, a storage region for retaining the skirt, and a fastener for releasably coupling the upper flap and the lower flap to retain the skirt in the storage region. In some embodiments, the skirt is directly attached to an interior section of the storage region. In some embodiments, the storage region comprises an upper flap and a lower flap. In some embodiments, the fastener comprises a sliding fastener, an interlocking fastener, a hook and loop fastener, or a magnetic closure.

In some embodiments, the skirt is foldable into the storage region. In some cases, the skirt is configured to fold upwards into the storage region. In some embodiments, the skirt comprises a plurality of end flaps that are foldable to reduce a storage area or volume of the skirt. In some embodiments, the plurality of end flaps are configured to fold inwards towards a center portion of the skirt to reduce the storage area or volume of the skirt. In some embodiments, the skirt is foldable along two or more axis to reduce a storage area or volume of the skirt.

In some embodiments, the skirt is attachable or affixable to the interior section of the storage region to restrict or limit a movement of the skirt when retained in the storage region. In some embodiments, the skirt is attachable or affixable to the interior section of the storage region using one or more fasteners.

In some embodiments, the skirt is directly attached to an inner layer or a lining of the garment. In some embodiments, the inner layer or lining forms at least a portion of the interior section of the storage region. In some embodiments, the skirt is attached to the inner layer or lining at a location proximal to the upper flap or the lower flap of the storage region.

In some embodiments, the skirt is configured to extend or unfold downwards when the skirt is deployed. In some embodiments, the skirt is configured to extend or unfold below the upper flap or the lower flap of the storage region when deployed. In some embodiments, the skirt is positioned between the lower flap of the storage region and (i) a body of the subject or (ii) another article worn by the subject when the skirt is deployed.

In some embodiments, a vertical length of the skirt is greater than or equal to a height of the storage region. In some embodiments, a vertical length of the skirt is less than or equal to a height of the storage region. In some embodiments, a horizontal length of the skirt is greater than or equal to a width of the storage region. In some embodiments, a horizontal length of the skirt is less than or equal to a width of the storage region. In some embodiments, the storage region extends across a width or a length of an inner layer or lining of the garment. In some embodiments, the upper flap of the garment has a greater height or vertical length than the lower flap of the garment. In some embodiments, the lower flap of the garment has a different height or vertical length than the upper flap of the garment. In some embodiments, the upper flap of the garment and the lower flap of the garment have a same or similar set of dimensions.

In some embodiments, the storage region is positioned above the skirt. In some embodiments, the storage region is positioned below the skirt. In some embodiments, the skirt is positioned (i) behind the upper flap or the lower flap when in a stored configuration and (ii) below the upper flap or the lower flap when in a deployed configuration.

In some embodiments, the skirt comprises an elastic material spanning a length of the skirt. In some embodiments, the elastic material is configured to create or provide a seal between an interior region of the garment and an environment external to the garment.

Additional aspects and advantages of the present disclosure will become readily apparent to those skilled in the art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

Non-limiting and non-exhaustive examples of the various embodiments disclosed herein are described with reference to the following figures.

DETAILED DESCRIPTION

Figure 1A:
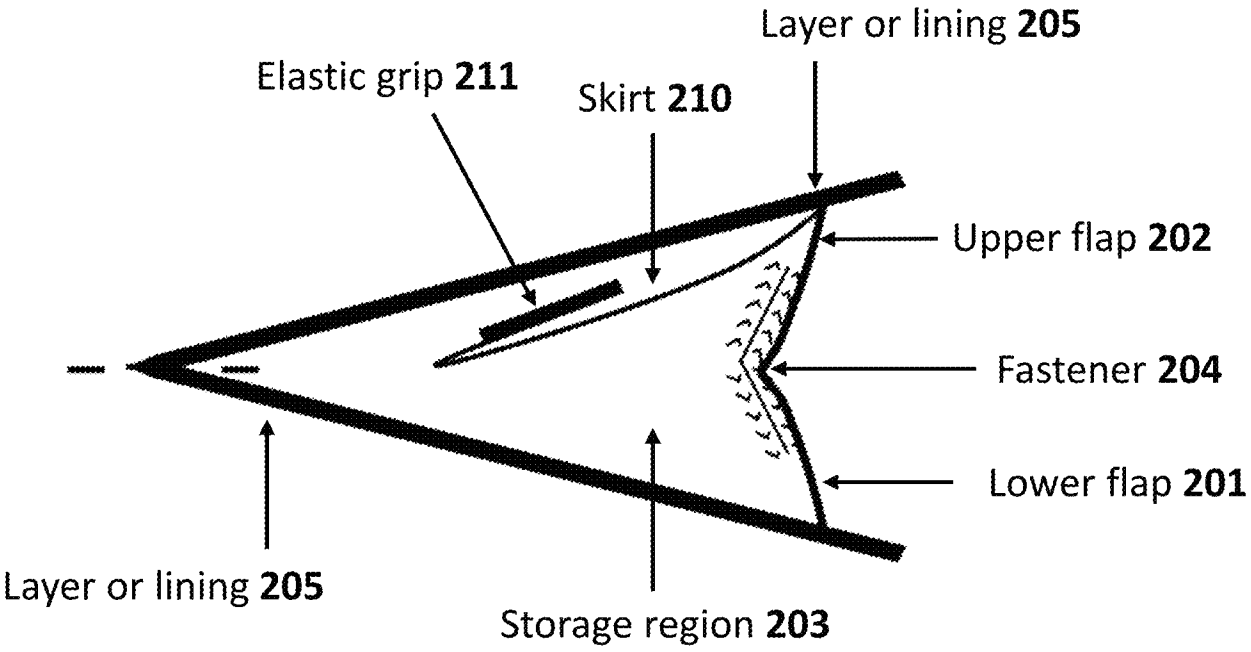
FIGS. 1A and 1B schematically illustrate various exemplary garments comprising a skirt that can be deployed from or hidden within a storage region of the garments, in accordance with some embodiments.

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

Overview

In an aspect, the present disclosure provides various embodiments of a garment comprising a barrier layer. In some embodiments, the garment may comprise an article of clothing. In some non-limiting embodiments, the article of clothing may include, for example, a jacket, a coat, a parka, a ski suit, a shell, a sweater, a hoodie, a vest, or any other type of article that can be worn by a subject. The subject may include, for example, an athlete or an individual engaging in one or more activities.

The garment may be worn by a subject engaging in one or more activities. In some embodiments, the one or more activities may comprise a physical activity (e.g., walking, running, hiking, skiing, snowboarding, golfing, etc.). In other embodiments, the one or more activities may comprise a non-physical activity (e.g., standing, sitting, resting, lying down, etc.) or any activity that either involves minimal movement or does not involve active movement.

In some embodiments, the one or more activities may be performed in a cool or cold environment. The cool or cold environment may have a temperature that is about 20 degrees Celsius, 15 degrees Celsius, 10 degrees Celsius, 5 degrees Celsius, 0 degrees Celsius, −5 degrees Celsius, −10 degrees Celsius, −15 degrees Celsius, −20 degrees Celsius, −25 degrees Celsius, −30 degrees Celsius, −35 degrees Celsius, −40 degrees Celsius, −45 degrees Celsius, −50 degrees Celsius, or less. In some embodiments, the one or more activities may be performed in a warm or hot environment. The warm or hot environment may have a temperature that is at least about 20 degrees Celsius, 25 degrees Celsius, 30 degrees Celsius, 35 degrees Celsius, 40 degrees Celsius, 45 degrees Celsius, 50 degrees Celsius, or more.

In some embodiments, the garment may comprise a torso portion having a front side and a back side. In some cases, the front side of the garment may be configured to cover a front portion of a subject's body. The front portion of the subject's body may include, for example, the subject's chest, abdomen, and/or pelvis. In some cases, the back side of the garment may be configured to cover a back portion of the subject's body. The back portion of the subject's body may include, for example, any portion or surface of the subject's body that is (i) between the subject's left and right shoulders and (ii) opposite from the subject's chest and/or abdomen. In any of the embodiments described herein, the front side and/or the back side of the garment may at least partially cover one or more side portions of the subject's body.

In some embodiments, the garment may comprise a right sleeve and a left sleeve. In some embodiments, the right sleeve may partially or fully cover the subject's right arm and/or shoulder. In some embodiments, the left sleeve may partially or fully cover the subject's left arm and/or shoulder. In any of the embodiments described herein, the right sleeve and/or the left sleeve may be attached to the torso portion of the garment. In some embodiments, the left and right sleeves may be attached to one or more sections of the torso portion of the garment which are adjacent to the subject's shoulders when the garment is worn by the subject.

In some embodiments, the garment may comprise a barrier layer that is secured to or integrated with the torso portion of the garment (e.g., one or more layers or panels of the torso portion of the garment). In some cases, the barrier layer may comprise a physical barrier between (1) an interior region of the garment and (2) an environment external to the garment. In some cases, the barrier layer may comprise a thermal barrier between (1) the interior region of the garment and (2) the environment external to the garment. In some cases, the interior region of the garment may include (i) any regions between the garment and the subject's body, (ii) any regions between the garment and another article worn by the subject, and/or (iii) any regions between the subject's body and any other article(s) worn by the subject.

In some embodiments, the barrier layer may comprise a skirt. In some cases, the skirt may be deployed or secured around the subject's body. When deployed, the skirt may be configured to prevent snow, rain or other precipitation, water, chemicals, wind, cold or hot air, dirt, or debris from reaching the subject's body or another article/layer worn underneath the garment.

In some embodiments, the skirt may be integrated with the garment. In some embodiments, the skirt may be permanently affixed to the garment (or a panel or layer thereof). In some embodiments, the skirt may be detachably coupled to the garment (e.g., using one or more fasteners or other mechanical attachments). When integrated with or coupled to the garment, the skirt may be configured to insulate or shield (i) a subject's body and/or (ii) one or more interior regions of the garment from (iii) external objects, climates, or environments.

In one aspect, the present disclosure provides a garment with a barrier layer. In some embodiments, the garment may comprise an article of clothing as described elsewhere herein. In some cases, the article of clothing may include, for example, a jacket, a coat, a parka, a shell, or any other type of article with at least one layer or panel that is configured to shield or insulate (directly or indirectly) a subject from a surrounding environment or climate in which the subject is present or through which the subject is moving.

In some embodiments, the garment may comprise a plurality of layers or panels. In some cases, the plurality of layers or panels may comprise two or more layers or panels of material. The material may comprise, for example, a fabric or a textile. In some non-limiting embodiments, the material may comprise cotton, silk, linen, cellulose, wool, cashmere, fleece, shearling, leather, polyester, nylon, acrylic, polyolefin, elastane, or any other type of synthetic or naturally occurring material.

In some embodiments, the plurality of layers may comprise an outer layer. In some cases, the outer layer may be a waterproof or water-resistant layer that is directly exposed to a surrounding environment in which the subject is located or through which the subject is moving. In some cases, the outer layer may be impermeable or semi-permeable to solids, liquids, and/or gases. In some cases, the outer layer may be selectively permeable or semi-permeable in different directions through the outer layer. In some cases, the outer layer may be selectively permeable in a first direction from an inner side of the outer layer (i.e., a side of the outer layer that is proximal to the subject's body) to an outer side of the outer layer (i.e., a side of the outer layer that is more distal to the subject's body) in order to (1) enhance the breathability of the garment and (2) expel or remove any unwanted moisture inside or within the garment (e.g., due to condensation of water vapor and/or perspiration). In some cases, the outer layer may be impermeable in a second direction from the outer side of the outer layer to the inner side of the outer layer in order to prevent a movement or ingress of precipitation (e.g., drizzle, rain, sleet, snow, ice pellets, and/or hail) into the garment.

In some embodiments, the plurality of layers may comprise one or more inner layers. The one or more inner layers may be positioned between the outer layer of the garment and the subject's body. In some cases, the one or more inner layers may comprise a lining or a liner. In some cases, the lining or liner may comprise an insulating material. The insulating material may include, for example, fleece, wool, down, cotton, polyester, or any other type of synthetic insulation. In some cases, the synthetic insulation may comprise cluster-fiber insulation (fiber balls that mimic tufts of down), short-staple insulation (a collection of short fibers that can move independently), and/or continuous-filament insulation (made of a continuous filament that intertwines with itself to create a mass of insulating fibers). In some cases, the lining or liner of the garment may comprise a different material than the outer layer of the garment.

In some embodiments, the barrier layer of the garment may comprise a skirt. In some embodiments, the skirt may comprise a piece of material that is attachable to an inside surface of the garment (or a panel or layer of said garment). The skirt may be extendable around a subject's body. As described elsewhere herein, the skirt may be configured to provide a barrier layer between an interior region of the garment and an environment external to the garment. In any of the embodiments described herein, the skirt may comprise a snow skirt or a powder skirt that is configured to prevent a movement or ingress of water, snow, precipitation, debris, dirt, wind, or cold air into the interior region of the subject's garment.

Hidden Snow Skirt

In one aspect, the present disclosure provides a garment with a barrier layer that can be fully hidden or concealed within a storage region of the garment and later deployed from the storage region when desired, without requiring a high level of dexterity or a complex series of steps to prepare the barrier layer for storage or deployment. The garment may provide a simple and elegant solution for storing and deploying the barrier layer without compromising (i) the functionality or accessibility of the barrier layer or (ii) the fit, comfort, or aesthetics of the garment.

In some embodiments, the barrier layer may comprise a skirt. In some embodiments, the skirt may comprise a snow skirt or a powder skirt. The skirt may be configured to provide a barrier between (i) a subject's body or an interior region of the garment when the garment is worn by the subject and (ii) an external environment. In some embodiments, the skirt may be hidable or concealable in a storage region provided within the garment. In some embodiments, at least a portion of the storage region may be formed by a panel, a layer, or a lining of the garment, as described in further detail elsewhere herein.

In some embodiments, the garment may comprise a storage region for retaining, storing, hiding, and/or concealing the skirt when the skirt is not in use. In some cases, the storage region may be integrated with the garment. In some cases, the storage region may be provided on or near a back/rear or side portion of an inside panel of the jacket. In some cases, the storage region may extend across a width of the garment. In some embodiments, a vertical length of the snow skirt may be greater than or equal to a height of the storage region. In other embodiments, a vertical length of the snow skirt may be less than or equal to a height of the storage region. In some embodiments, a horizontal length of the skirt may be greater than or equal to a width of the storage region. In other embodiments, a horizontal length of the skirt may be less than or equal to a width of the storage region.

In some embodiments, the storage region may be integrated with a layer or a panel of the garment. In some embodiments, at least a portion of the storage region may be formed by a layer or a panel of the garment. In some embodiments, at least a portion of the storage region may be formed using a plurality of pieces that are secured or attached to a layer or a panel of the garment. In some embodiments, the plurality of pieces may comprise two or more flaps that can be detachably secured to each other (e.g., using a fastener or an attachment mechanism) to form an enclosed or partially enclosed space or volume for storing the skirt.

In some embodiments, the storage region may have an upper flap and a lower flap. In some embodiments, the storage region may have an opening that is formed when the upper flap and the lower flap are detached from each other and/or separated. In some cases, the upper flap and the lower flap may be separated to create, form, or expand the opening of the storage region. In some cases, the upper flap and the lower flap may be brought together to contract or close the opening. In some cases, the upper flap and the lower flap may be fastened or coupled together to partially or fully close the opening.

In some cases, the upper flap may be longer than the lower flap. In other cases, the lower flap may be longer than the upper flap. In some cases, the upper flap of the garment may have a greater vertical length than the lower flap of the garment. In other cases, the lower flap of the garment may have a greater vertical length than the upper flap of the garment. In some cases, the upper flap and the lower flap may have a same or similar set of dimensions (e.g., a same or similar length, width, height, etc.).

In some embodiments, the opening formed between the upper flap and the lower flap (e.g., when the upper flap and the lower flap are detached and/or separated from each other) may be proximal to the upper flap of the storage region. In other embodiments, the opening formed between the upper flap and the lower flap (e.g., when the upper flap and the lower flap are detached and/or separated from each other) may be proximal to the lower flap of the storage region. In some embodiments, the interface formed between the upper flap and the lower flap (e.g., when the upper flap and the lower flap are joined together using a fastener) may be (i) a first distance from an interface between the upper flap and a layer or panel of the garment and (ii) a second distance from an interface between the lower flap and a layer or panel of the garment. In some cases, the first distance may be greater than or equal to the second distance. In other cases, the first distance may be less than or equal to the second distance. In some non-limiting embodiments, the interface between (i) the upper flap and (ii) a layer or panel of the garment may correspond to a section or a portion of the garment layer or panel to which the upper flap is attached. In some non-limiting embodiments, the interface between (i) the lower flap and (ii) a layer or panel of the garment may correspond to a section or a portion of the garment layer or panel to which the lower flap is attached. In some non-limiting embodiments, the interface between (i) the lower flap or the upper flap and (ii) the layer or panel of the garment may comprise one or more seams or stitches securing the lower flap or the upper flap to the layer or panel of the garment.

In some embodiments, the garment may comprise a fastener for releasably coupling the upper flap and the lower flap. In some embodiments, the fastener may comprise a sliding fastener, one or more snap fitting elements, or a magnetic coupler or closure. In some embodiments, the fastener may be configured to join the upper flap and the lower flap to close the opening of the storage region (e.g., when the skirt is placed into the storage region). In some embodiments, the fastener may be configured to detach the upper flap and the lower flap to open the storage region (e.g., when the subject wearing the garment wants to deploy the skirt from the storage region).

In some embodiments, the skirt may be directly attached to an interior portion of the storage region (e.g., an interior surface, section, or contour of the storage region). In some embodiments, the interior portion of the storage region may correspond to an inner layer or a lining of the garment. In some embodiments, the skirt may be directly attached to an inner layer or lining of the garment. In some embodiments, the skirt may be attached to the inner layer or lining of the garment at a location proximal to the upper flap or the lower flap of the storage region. In some embodiments, the skirt may be attached to a portion of the inner layer or lining of the garment that is centrally located between the upper flap and the lower flap. In some embodiments, the skirt may be attachable or affixable to an interior region of the storage region (e.g., using snap fits) to secure and/or retain the skirt within the storage region. In some embodiments, the skirt may be attachable or affixable to an interior region of the storage region to restrict or limit a movement of the skirt when the skirt is placed in the storage region.

In some non-limiting embodiments, at least a portion of the storage region may be positioned above the skirt. In other non-limiting embodiments, at least a portion of the storage region may be positioned below the skirt. In some non-limiting embodiments, the skirt may be positioned behind the upper flap of the storage region (e.g., between the upper flap and a layer or a panel of the garment) or under the upper flap. In other non-limiting embodiments, the skirt may be positioned behind the lower flap of the storage region (e.g., between the lower flap and a layer or a panel of the garment) or under the lower flap. In some embodiments, the skirt may be positioned behind the upper flap or the lower flap (e.g., between the upper or lower flap and a layer or panel of the garment) when the skirt is in a stored configuration. In some embodiments, the skirt may be positioned between the subject's body and the lower flap when the skirt is in a deployed configuration. In some embodiments, the skirt may be positioned below the upper flap and/or below the lower flap when the skirt is in a deployed configuration.

In some embodiments, the skirt may be foldable along two or more axis to reduce a storage area or volume of the skirt. In some cases, the skirt may be configured to fold upwards along a lateral axis onto itself and into the storage region (e.g., when a subject wearing the garment does not need or want to use the skirt). In some cases, the skirt may comprise a plurality of end flaps that are foldable to reduce a storage area or volume of the skirt. In some cases, the plurality of end flaps may be configured to fold inwards along one or more lateral axes towards a center portion of the skirt and/or onto the body of the skirt to reduce the storage area or volume of the skirt. In some embodiments, the lateral axis along which the body of the skirt is foldable and the one or more lateral axes along which the plurality of end flaps are foldable may be oriented in different directions in two-dimensional or three-dimensional space.

In some embodiments, the skirt may be configured to extend or unfold downwards when the skirt is deployed. In some embodiments, the skirt may be configured to extend or unfold below the storage region when deployed. In some cases, the skirt may extend or unfold below the upper flap and/or the lower flap of the storage region when deployed. In some embodiments, the skirt may be positioned between the lower flap of the storage region and (i) a body of the subject or (ii) another article worn by the subject when the skirt is deployed.

FIG. 1A schematically illustrates an exemplary garment comprising a skirt 210 that can be deployed from or hidden within a storage region 203 of the garment. In some embodiments, the skirt 210 may comprise an elastic grip material 211. In some cases, the elastic grip material 211 may be provided on a portion of the skirt 210 that is configured to contact another layer or article worn by the subject. In some cases, the elastic grip material 211 may be used to form a physical and/or thermal barrier between the interior regions of the jacket and an external environment when the skirt 210 is deployed.

In some embodiments, the skirt 210 may be directly attached to an interior portion of the storage region 203. In some embodiments, the skirt 210 may be directly attached to a layer or lining 205 of the garment at a location proximal to an upper portion or a lower portion of the storage region. In some non-limiting embodiments, a surface or portion of the layer or lining 205 of the garment may correspond to the interior portion of the storage region 203. In some non-limiting embodiments, the surface or portion of the layer or lining 205 to which the skirt 210 is directly attached may correspond to a surface or a portion of the layer or lining 205 that is oriented towards a subject's body when the subject is wearing the garment.

In some embodiments, the garment may comprise a lower flap 201 and an upper flap 202. In some cases, the lower flap 201 and the upper flap 202 may be directly attached to a layer or lining 205 of the garment. In some cases, the lower flap 201 and/or the upper flap 202 may be directly attached to the same layer or lining of the garment as the skirt 210. In some embodiments, the lower flap 201 may be configured to extend upwards towards the upper flap 202. In some embodiments, the upper flap 202 may be configured to extend downwards towards the lower flap 201.

In some embodiments, the lower flap 201, the upper flap 202, and the layer or lining 205 of the garment may collectively form the storage region 203 for the skirt 210. In some embodiments, the lower flap 201 and the upper flap 202 may be decoupled or detached using a fastener 204 to open the storage region 203 so that the skirt 210 can be accessed and deployed by a subject wearing the garment. In some embodiments, the lower flap 201 and the upper flap 202 may be coupled together using the fastener 204 in order to close the storage region 203 and hide or conceal the skirt 210.

In some embodiments, the skirt 210 may be configured to extend downwards or below the storage region 203 when the skirt 210 is deployed. In some cases, when the skirt 210 is deployed, the bottom or lower flap 201 of the storage region 203 may be positioned between the deployed skirt 210 and the garment layer or lining 205 to which the skirt 210 is directly attached.

In some embodiments, the skirt 210 may be placed within the storage region 203 when a subject wishes to hide or conceal the skirt 210. In some embodiments, the skirt 210 may be foldable upwards into the storage region when the skirt 210 is not needed or desired. In some cases, when the skirt 210 is hidden or concealed, the skirt 210 may be positioned between (i) the lower flap 201 and/or the upper flap 202 and (ii) the garment layer or lining 205 to which the skirt 210 is directly attached.

Figure 1B:
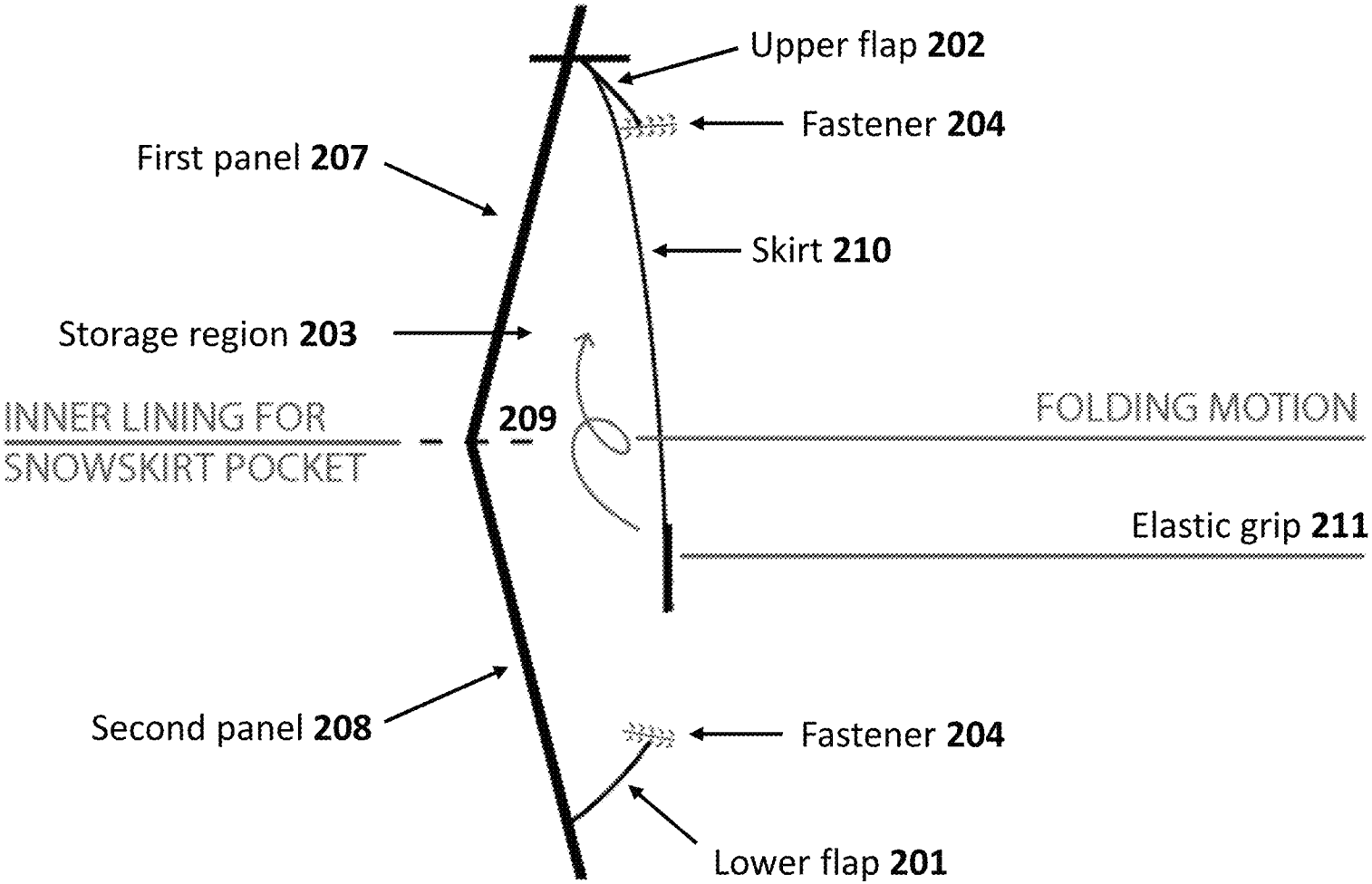

FIG. 1B schematically illustrates another example of a skirt 210 that can be hidden or concealed within a storage region 203 of the garment. In some embodiments, the storage region 203 may be formed on one side by a first panel 207 and a second panel 208 of a garment layer or lining. In some embodiments, the storage region 203 may be formed on another side by an upper flap 202 and a lower flap 201.

In some embodiments, the storage region 203 may be formed on one side by a first panel 207 and a second panel 208. In some cases, the first panel 207 and/or the second panel 208 may be part of an inner layer or lining of the storage region 203 (e.g., the inner layer or lining 205 shown in FIG. 1A).

In some cases, the first panel 207 and the second panel 208 may be attached with a seam or a stitch 209. The seam or stitch 209 may be used to adjust or set a position and/or an orientation of the first panel 207 relative to the second panel 208, and/or vice versa. In some cases, the seam or stitch 209 may place the first panel 207 and the second panel 208 in an angled orientation or arrangement to create additional space or volume in the storage region 203 for accommodating the skirt 210. The additional space or volume may be adjustable in size and/or shape to accommodate the skirt 210 in a wide variety of different physical states (e.g., flat, rolled, folded, scrunched or bunched up, and/or any combination thereof). In some cases, the angle between the first panel 207 and the second panel 208 can range from about 30 degrees to about 180 degrees. In some cases, the angle may be adjustable by pulling or tensioning the first panel 207 or the second panel 208. In some cases, the seam or stitch 209 may permit a movement of the first panel 207 relative to the second panel 208, and/or vice versa. In some cases, the seam or stitch 209 may not or need not restrict a movement of the first panel 207 relative to the second panel 208, or vice versa, in order to provide a flexible storage space or volume for accommodating, concealing, and/or storing skirts in a wide variety of different physical states.

In some embodiments, the storage region 203 may be formed on another side opposite the first panel 207 and the second panel 208 by an upper flap 202 and a lower flap 201. The upper flap 202 may be attached to the first panel 207 or another portion of the garment that is directly or indirectly coupled to the first panel 207. The lower flap 201 may be attached to the second panel 208 or another portion of the garment that is directly or indirectly coupled to the second panel 208. In some embodiments, corresponding fasteners 204 may be integrated with the first panel 207 and the second panel 208 to allow a subject to couple the first panel 207 and the second panel 208 together. The fasteners 204 may include a sliding fastener (e.g., a zipper), an interlocking fastener (e.g., a snap closure, a press stud, or a fit lock), a hook and loop fastener (e.g., VELCRO™), a magnetic fastener, or any other type of functionally or mechanically equivalent fastener. In some embodiments, the fasteners 204 may be fixed into one or more seams on the first panel 207 and/or the second panel 208.

In some embodiments, the skirt 210 may be attached to a portion of the garment that is proximal to the first panel 207 and/or the upper flap 202. In some embodiments, the skirt 210 may be configured to hang downwards from an attachment point coupling the skirt 210 to the first panel 207 and/or the upper flap 202. In some embodiments, the skirt 210 may be configured to hang downwards from this attachment point regardless of whether the skirt 210 is in a deployed configuration or a stored configuration. In some embodiments, the skirt 210 may be configured to hang downwards from the attachment point when the skirt 210 is deployed. In some embodiments, the skirt 210 may be configured to hang downwards from the attachment point when the skirt 210 is stored, hidden, or concealed within the storage region 203.

In some embodiments, when a subject wearing the garment wishes to store the skirt 210, the subject may roll or fold the skirt upwards (either inwards towards the first panel 207 or the second panel, or in an opposite outwards direction) for compact storage within the storage region 203. The fasteners 204 may be secured to each other once the skirt 210 is placed in the storage region 203, in order to create an enclosed volume or space for housing the skirt 210 out of view and out of the way when the skirt 210 is not in use. When the subject wishes to deploy the stowed skirt 210, the subject may uncouple the fasteners 204 to release the upper flap 202 and/or the lower flap 201. In some cases, the skirt 210 may deploy downwards automatically by way of gravity. In other cases, the downward deployment of the skirt 210 may be controlled (e.g., either based on a physical input or action by the subject, or by another fastener such as a magnetic fastener that can keep the stowed skirt 210 temporarily within the storage region 203, even after the upper flap 202 and the lower flap 201 are uncoupled to expose the interior of the storage region 203).

In some non-limiting embodiments, the skirt 210 may further comprise a silicone gripper material 211. As described elsewhere herein, the silicone gripper material 211 may be provided on a portion of the skirt 210 that is configured to contact another layer or article worn by a subject. The silicone gripper material 211 may be configured to form a seal between the interior regions of the jacket and the external environment to enhance the effectiveness of the physical and/or thermal barrier provided by the skirt 210 when deployed. In some cases, the silicone gripper material 211 may be disposed on a portion of the skirt 210 that is oriented towards a subject's body.

Figures 1C, 1D, 1E:
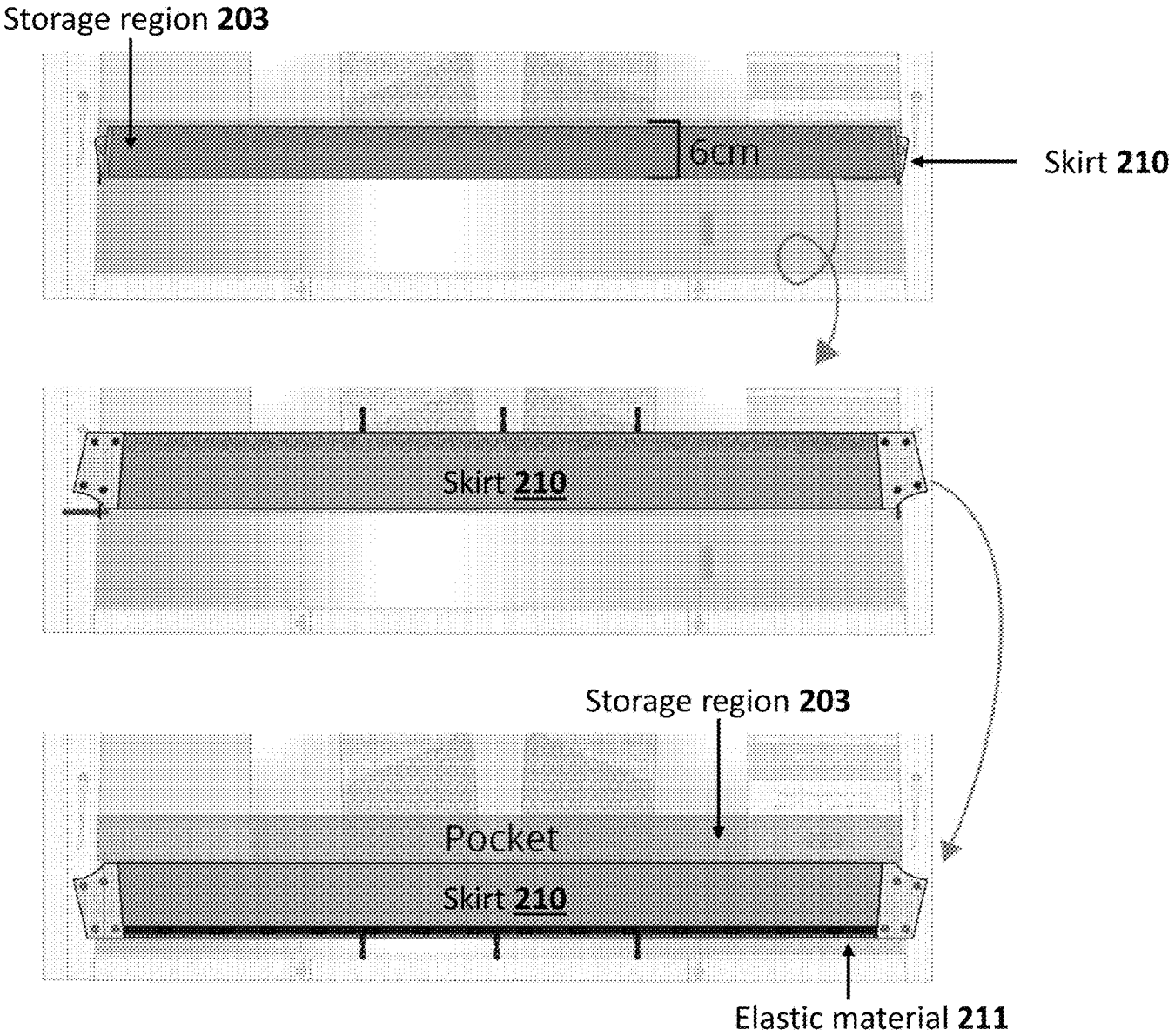
FIGS. 1C-1E and FIGS. 1F-1H schematically illustrate a method for deploying a skirt from a storage region of a garment, in accordance with some embodiments.
Figure 1F:
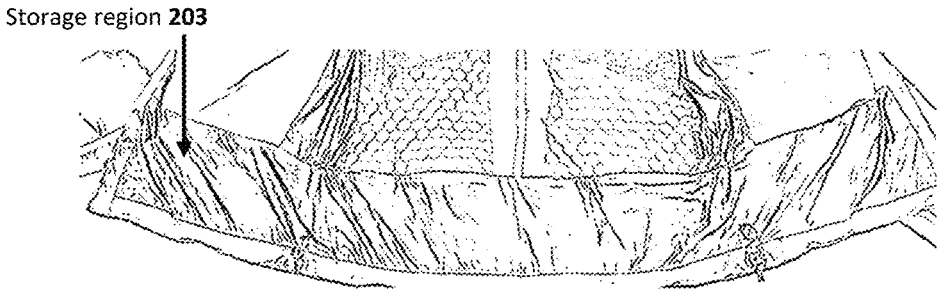
Figure 1G:
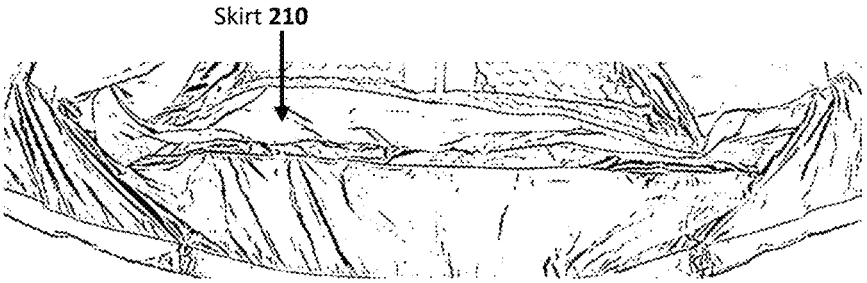
Figure 1H:
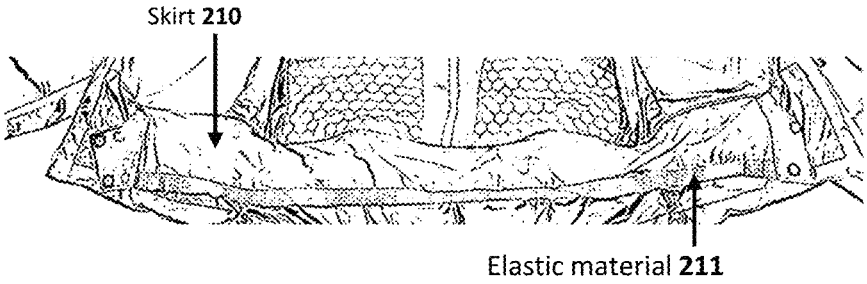

FIGS. 1C-1E and FIGS. 1F-1H illustrate an exemplary method for deploying a skirt 210 that can be hidden or concealed within a storage region 203 of the garment. In some embodiments (e.g., as shown in FIGS. 1C and 1F), the skirt 210 may be initially positioned within the storage region 203 of the garment. In some cases, the skirt 210 may be stored in a folded configuration. Referring to FIGS. 1D and 1G, in some embodiments, the skirt 210 may be unfolded and removed from the storage region 203 (e.g., by pulling the skirt up or down and out of the storage region). As shown in FIGS. 1E and 1H, once the skirt 210 is unfolded and removed from the storage region 203, the skirt 210 may be extended downwards (e.g., by way of gravity and/or manipulation by a subject wearing the garment) to fully deploy the skirt 210.

In any of the embodiments described herein, the skirt 210 may be placed in the storage region 203 when the skirt 210 is not needed, required, or desired. In some embodiments, if the skirt 210 is already deployed (e.g., as shown in FIGS. 1E and 1H), the bottom edge of the skirt 210 may be moved or reoriented upwards (e.g., as shown in FIGS. 1D and 1G) to prepare the skirt for storage. In some embodiments, the skirt 210 and/or any end flaps of the skirt may be rearranged or folded on itself before the skirt 210 is placed in the storage region 203 of the garment (e.g., as shown in FIGS. 1C and 1F).

Figure 1I:
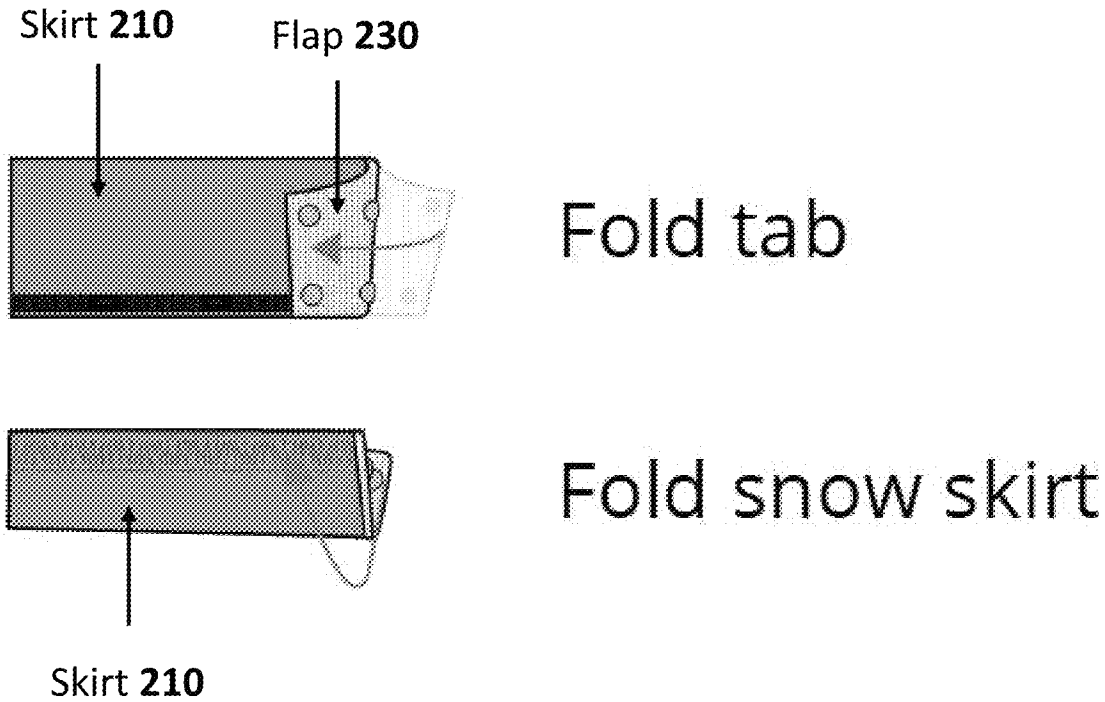
FIG. 1I schematically illustrates one or more optional steps for folding one or more portions of a skirt before placing the skirt in a storage region of the garment, in accordance with some embodiments.

As discussed above, in some cases, the skirt 210 may be folded on itself before the skirt 210 is placed in the storage region 203 of the garment. FIG. 1I schematically illustrates one or more optional steps for folding one or more portions of a skirt 210 for placement in a storage region of the garment. In some embodiments, the skirt 210 may comprise a plurality of end flaps 230 that are foldable onto the body of the skirt to reduce a storage area or volume of the skirt. In some embodiments, the skirt 210 may also be folded upwards or downwards on itself to reduce the storage area or volume of the skirt. In any of the embodiments described herein, the skirt 210 and/or any portions thereof may be folded one or more times before the skirt 210 is placed within the storage region 203 of the garment.

In any of the embodiments described herein, the skirt 210 may comprise an elastic material extending across a length of the skirt 210. In some cases, the elastic material may extend along a bottom edge of the skirt 210. In some non-limiting embodiments, when the skirt 210 is deployed downwards, the elastic material may be positioned at or near a lower edge of the garment so that the elastic material can create a physical barrier around a subject's body. In some cases, the physical barrier may be configured to limit or prevent a passage of cold air, dirt, debris, precipitation, water, and/or snow into the interior of the garment via the lower edge of the garment. In some embodiments, the elastic material may be configured to create or provide a seal between an interior region of the garment and an environment external to the garment.

Skirt Properties

In some embodiments, the skirts described herein may have a length or a width. In some cases, the skirts may have a length or a width ranging from about 12 inches to about 24 inches. In some cases, the skirts may have a length or a width ranging from about 24 inches to about 36 inches. In some cases, the skirts may have a length or a width ranging from about 36 inches to about 48 inches. In some cases, the skirts may have a length or a width that is less than or equal to about 12. In some cases, the skirts may have a length or a width that is greater than or equal to about 48 inches.

In some embodiments, the skirts described herein may have a height or a vertical length. In some cases, the skirts may have a height or a vertical length ranging from about 1 inch to about 2 inches. In some cases, the skirts may have a height or a vertical length ranging from about 2 inches to about 3 inches. In some cases, the skirts may have a height or a vertical length ranging from about 3 inches to about 4 inches. In some cases, the skirts may have a height or a vertical length ranging from about 4 inches to about 5 inches. In some cases, the skirts may have a height or a vertical length ranging from about 5 inches to about 6 inches or more.

In some embodiments, the skirts described herein may have a cross-sectional shape (as viewed from a front perspective or a rear perspective view of the garment) when the garment is fully opened and the skirt is arranged in a flat or substantially flat configuration. In some cases, the cross-sectional shape may comprise a rectangle, a trapezoid, a parallelogram, or any other polygon having three or more sides. In some cases, the cross-sectional shape may have a dimension that varies along (i) a length or a width of the skirt and/or (ii) a height or a vertical length of the skirt.

In some embodiments, the skirts described herein may comprise a material (also referred to herein as a "skirt material"). In some embodiments, the skirt material may be different than a material of the garment to which the skirt is attached or coupled. In other embodiments, the skirt material may be the same material or a similar material as the material of the garment. In some non-limiting embodiments, the skirt material may comprise polyester, nylon, acrylic, polyolefin, and/or elastane. In some non-limiting embodiments, the skirt may comprise a natural insulation (e.g., wool or down) and/or a synthetic insulation (e.g., cluster-fiber insulation, short-staple insulation, and/or continuous-filament insulation).

In some cases, the skirt material may be stretchable and/or expandable in one or more directions. In other cases, the skirt material may comprise a relatively non-elastic material that resists stretching or expansion in one or more directions.

In some cases, the skirt material may be relatively lightweight. In some cases, the skirt material may have a weight or density of less than about 50 grams per square meter (gsm). In some cases, the skirt material may have a weight or density ranging from about 10 gsm to about 50 gsm or more.

In some embodiments, the skirt material may comprise a durable or weather-resistant material. In some cases, the durable or weather-resistant material may comprise a water resistant or hydrophilic material. In some cases, the water resistant or hydrophilic material may be coated on a portion or a section of the skirt. In some non-limiting embodiments, the coating may prevent water moisture from entering inside the garment through the portion or section of the skirt with the coating applied thereon.

In some embodiments, the skirt material may be water repellant. In some embodiments, hydrophobic coatings may be applied to the skirt to provide a durable water repellent (DWR) layer which helps to repel water droplets impinging on the skirt. In some embodiments, water-resistant fabrics may be used for the skirt material. As used herein, the term "water-resistant fabric" may refer to a fabric that is substantially impervious to water. In some embodiments, the term "water-resistant fabric" may include a fabric that has a water resistance of at least about 1,000 mm (i.e., about 1,000 mm of water can be suspended above the fabric before water begins to seep through). In some embodiments, the skirt material may have a water resistance greater than about 10,000 mm. In some embodiments, the skirt material may have a water resistance greater than about 20,000 mm. In some embodiments, the skirt material may have a water resistance greater than about 30,000 mm. In some embodiments, the skirt material may have a water resistance greater than about 40,000 mm. In some embodiments, the skirt material can have a water resistance greater than about 50,000 mm.

In some embodiments, the skirt material may be weather resistant. As used herein, the term "weather-resistant fabric" may refer to a fabric that is generally resistant to water and/or wind. In some instances, a "weather-resistant fabric" may comprise a fabric that is substantially impervious to water and exhibits a low rate of moisture vapor transmission. The moisture vapor transmission rate may correspond to the rate at which vapor passes through a material.

In some embodiments, the skirt material may have a water vapor permeability of at least about 1,000 $g/m^2/24$ hr. In some embodiments, the skirt material may have a water vapor permeability of at least about 10,000 $g/m^2/24$ hr. In some embodiments, the skirt material may have a water vapor permeability of at least about 20,000 $g/m^2/24$ hr. In some embodiments, the skirt material may have a water vapor permeability of at least about 30,000 $g/m^2/24$ hr. In some embodiments, the skirt material may have a water vapor permeability of at least about 40,000 $g/m^2/24$ hr. In some embodiments, the skirt material may have a water vapor permeability of at least about 50,000 $g/m^2/24$ hr or more.

In some embodiments, the ratio of water resistance to water vapor permeability for the skirt material may be about 1.0. In some embodiments, the ratio of water resistance to water vapor permeability for the skirt material may range from about 1.0 to about 2.0. In some embodiments, the ratio of water resistance to water vapor permeability for the skirt material may range from about 2.0 to about 3.0. In some embodiments, the ratio of water resistance to water vapor permeability for the skirt material may range from about 3.0 to about 4.0. In some embodiments, the ratio of water resistance to water vapor permeability for the skirt material may range from about 4.0 to about 5.0.

Although specific embodiments are described herein, one of skill in the art will appreciate that these articles are provided for illustrative purposes, and that other articles may be employed to perform the functionalities disclosed herein without departing from the scope of the disclosure. Moreover, while different examples and embodiments may be described separately, such embodiments and examples may be combined with one another to implement the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A garment, comprising:

a jacket comprising an inner layer and an outer layer overlapping the inner layer, the inner layer comprising a first panel, a second panel, and a seam joining the first panel and the second panel along a horizontal seam line extending between the first panel and the second panel;

a skirt attached to the inner layer of the jacket toward the waist band of the jacket;

an upper flap and a lower flap attached to the inner layer of the jacket to form a storage region within the jacket for retaining the skirt, wherein a portion of the inner layer forms an inner wall of the storage region, and wherein the skirt is directly attached to said inner wall of the storage region;

and a fastener for releasably coupling the upper flap and the lower flap to retain the skirt in the storage region, wherein the upper flap is attached to the first panel of the inner layer at a first location above the horizontal seam line, and wherein the lower flap is attached to the second panel of the inner layer at a second location below the horizontal seam line.

2. The garment of claim 1, wherein the skirt is foldable into the storage region.

3. The garment of claim 1, wherein the skirt comprises a plurality of end flaps that are foldable to reduce a size or a volume of the skirt.

4. The garment of claim 1, wherein the skirt is foldable along two or more axes to reduce a size or a volume of the skirt.

5. The garment of claim 1, wherein the skirt is configured to extend or unfold downwards when the skirt is deployed.

6. The garment of claim 1, wherein the skirt is configured to extend or unfold below the upper flap or the lower flap when the skirt is deployed.

7. The garment of claim 1, wherein the skirt is positioned between the lower flap of the storage region and (i) a body of a subject wearing the garment or (ii) another article worn by the subject when the skirt is deployed.

8. The garment of claim 1, wherein a vertical length of the skirt is greater than or equal to a height of the storage region.

9. The garment of claim 1, wherein a horizontal length of the skirt is greater than or equal to a width of the storage region.

10. The garment of claim 1, wherein the skirt is positioned (i) behind the upper flap or the lower flap when in a stored configuration and (ii) below the upper flap or the lower flap when in a deployed configuration.

11. The garment of claim 1, wherein the upper flap of the garment has a different height or vertical length than the lower flap of the garment.

12. The garment of claim 1, wherein the upper flap of the garment has a same set of dimensions as the lower flap of the garment.

13. The garment of claim 1, wherein a portion of the skirt is attachable or affixable to an interior section of the storage region to restrict or limit a movement of the skirt when the skirt is positioned within the storage region.

14. The garment of claim 1, wherein the skirt comprises an elastic material spanning a length of the skirt, wherein the elastic material is configured to create or provide a seal between an interior region of the garment and an environment external to the garment.

15. The garment of claim 1, wherein the seam is configured to place the first panel and the second panel in an angled orientation or arrangement that is adjustable to accommodate the skirt in a plurality of different physical states.

16. The garment of claim 15, wherein the angled orientation or arrangement is adjustable by pulling or tensioning the first panel or the second panel.

17. The garment of claim 1, wherein a bottom edge of the lower flap is stitched directly to the inner layer of the jacket to close off a lower end of the storage region.

18. The garment of claim 1, wherein the upper flap and the lower flap are separable to form an opening that extends above a bottom edge portion of the lower flap and below a top edge portion of the upper flap.

19. The garment of claim 1, wherein the skirt is directly attached to a portion of the inner layer of the jacket that is located above a seamed or stitched interface joining the lower flap to the inner layer of the jacket.

20. The garment of claim 1, wherein the skirt is deployable from the storage region by pulling the skirt upwards and out of the storage region before deploying the skirt downwards.

* * * * *